US010808686B2

(12) United States Patent
Maekawa et al.

(10) Patent No.: US 10,808,686 B2
(45) Date of Patent: Oct. 20, 2020

(54) HYDRAULIC ROTARY MACHINE

(71) Applicant: Kabushiki Kaisha Kobe Seiko Sho (Kobe Steel, Ltd.), Kobe-shi (JP)

(72) Inventors: Satoshi Maekawa, Kobe (JP); Naoki Sugano, Kobe (JP); Kei Morita, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 156 days.

(21) Appl. No.: 16/084,848

(22) PCT Filed: Mar. 7, 2017

(86) PCT No.: PCT/JP2017/008898

§ 371 (c)(1),
(2) Date: Sep. 13, 2018

(87) PCT Pub. No.: WO2017/169552

PCT Pub. Date: Oct. 5, 2017

(65) Prior Publication Data

US 2020/0063723 A1 Feb. 27, 2020

(30) Foreign Application Priority Data

Mar. 28, 2016 (JP) ..... 2016-063803
Dec. 22, 2016 (JP) ..... 2016-249264

(51) Int. Cl.
*F04B 1/2085* (2020.01)
*F03C 1/06* (2006.01)
(Continued)

(52) U.S. Cl.
CPC ..... *F04B 1/2085* (2013.01); *F03C 1/0639* (2013.01); *F03C 1/0671* (2013.01);
(Continued)

(58) Field of Classification Search
CPC ..... F04B 1/324; F04B 1/22; F04B 1/2085; F03C 1/0639; F03C 1/0671
See application file for complete search history.

(56) References Cited

U.S. PATENT DOCUMENTS 3,682,047 A * 8/1972 Anderson ..... F04B 1/2078 91/505
3,933,082 A 1/1976 Molly
(Continued)

FOREIGN PATENT DOCUMENTS

CN 101415944 B 12/2010
CN 203067204 U 7/2013
(Continued)

OTHER PUBLICATIONS

International Search Report dated May 16, 2017 in PCT/JP2017/008898 filed Mar. 7, 2017.
(Continued)

*Primary Examiner* — Thomas E Lazo
(74) *Attorney, Agent, or Firm* — Oblon, McClelland, Maier & Neustadt, L.L.P.

(57) ABSTRACT

A hydraulic rotary machine configured to reduce sliding resistance of a reciprocating piston and to suppress a reduction in volumetric efficiency corresponding to an amount of leakage of hydraulic oil. A piston pump includes a rotor shaft, a cylinder block, a piston head, a piston rod, a retainer, a swash plate, and a tilt regulation mechanism. When the tilt regulation mechanism rocks the swash plate, the amount of discharge from the piston pump is variably changed. The retainer which rotates with both the piston head and the piston rod is supported by a retainer bush provided to the rotor shaft. The retainer sphere section of the retainer and the retainer bush sphere section of the retainer bush have spherical shapes having the same curvature. During the
(Continued)

regulation of tilt, the retainer rocks while the retainer bush sphere section is in sliding contact with the retainer bush.

5 Claims, 9 Drawing Sheets

(51) Int. Cl.
*F03C 1/40* (2006.01)
*F04B 1/22* (2006.01)
*F04B 1/324* (2020.01)

(52) U.S. Cl.
CPC ..... *F03C 1/0686* (2013.01); *F04B 1/22* (2013.01); *F04B 1/324* (2013.01)

(56) References Cited

U.S. PATENT DOCUMENTS 9,157,423 B2 * 10/2015 Tvaruzek ..... F04B 1/2014
2004/0194460 A1 10/2004 Ito et al.
2009/0007773 A1 * 1/2009 Zhu ..... F04B 1/128 91/505
2014/0147298 A1 * 5/2014 Diebold ..... F03C 1/0686 417/222.1

FOREIGN PATENT DOCUMENTS

| | | | |
|---|---|---|---|
| EP | 2 012 010 | A1 | 1/2009 |
| JP | 49-80602 | A | 8/1974 |
| JP | 57-105574 | A | 7/1982 |
| JP | 2003-113776 | A | 4/2003 |
| JP | 2009-250204 | A | 10/2009 |

OTHER PUBLICATIONS

International Preliminary Report on Patentability and Written Opinion dated Oct. 11, 2018 in PCT/JP2017/008898 (submittin English translation only), citing document AO therein, 9 pages.
Extended European Search Report dated Sep. 26, 2019 in European Patent Application No. 17774097.4 citing documents AA and AO therein, 8 pages.

* cited by examiner

HYDRAULIC ROTARY MACHINE

TECHNICAL FIELD

The present invention relates to a hydraulic rotary machine that can be used as a hydraulic pump or a hydraulic motor.

BACKGROUND ART

A conventional hydraulic rotary machine of a variable displacement type that can be used as a hydraulic pump or a hydraulic motor is known. Such a hydraulic rotary machine includes a housing, a rotor shaft, a cylinder block, and a plurality of pistons. The rotor shaft is rotatably supported by the housing. The cylinder block includes a plurality of cylinders provided around a central axis of the rotor shaft and rotates together with the rotor shaft. Each piston is housed in each of a plurality of cylinders in the cylinder block and reciprocates along with the rotating cylinder block.

In the case that the hydraulic rotary machine is used as a hydraulic pump, the output from a driving unit rotates the rotor shaft, thereby rotating the cylinder block together with the rotor shaft and reciprocating each of the pistons. In this motion, hydraulic oil flows into the cylinder in the cylinder block from a low pressure port and is pressurized by the piston, and then the hydraulic oil is discharged from a high pressure port.

In the case that the hydraulic rotary machine is used as a hydraulic motor, the high pressure hydraulic oil flows into the cylinder of the cylinder block from the high pressure port and acts on the piston. The reciprocating piston rotates the rotor shaft together with the cylinder block and then the hydraulic oil is discharged from the low pressure port.

Patent Literature 1 discloses a hydraulic pump having a swash plate. The hydraulic pump has, in addition to the configuration described above, a rocking member supported in a housing to rock, and a swash plate rotatably supported by the rocking member. The swash plate is in contact with a plunger (piston) and rotates about an axis different from the rotor shaft. By rocking of the rocking member, the tilt angle of the swash plate to the rotor shaft is regulated. The reciprocation stroke of the piston is regulated by the tilt angle of the swash plate, and thus the discharge amount of the hydraulic pump is changed.

CITATION LIST

Patent Literature

Patent Literature 1: JP3962348 B1

SUMMARY OF INVENTION

A hydraulic pump described in Patent Literature 1 includes a plunger and a swash plate having hemispherical portions of different curvatures. The swash plate rotates about an axis different from the rotor shaft, and thus the plunger reciprocates with the hemispherical portion of the plunger making a point-contact with the hemispherical portion of the swash plate. The sliding resistance at the contact between the plunger and the swash plate may locally become large and adhesive wear of the plunger is likely to occur. For this reason, a larger amount of hydraulic oil leakage is required for lubrication, which disadvantageously deteriorates the volumetric efficiency of the hydraulic rotary machine.

An object of the present invention is to provide a hydraulic rotary machine configured so as to reduce the sliding resistance of a reciprocating piston and so as to suppress a reduction in volumetric efficiency corresponding to the amount of leakage of hydraulic oil.

A hydraulic rotary machine of a variable displacement type according to an aspect of the present invention includes a housing, a rotor shaft rotatably supported by the housing, a cylinder block that includes a plurality of cylinders intermittently disposed around the rotor shaft and revolves together with the rotor shaft about a central axis of the rotor shaft, a plurality of pistons that are each housed in each of the plurality of cylinders in the cylinder block and reciprocates in an axial direction in the cylinder along with rotation of the cylinder block, a retainer bush that includes a bush outer circumferential surface and is supported on the rotor shaft to rotate about the central axis along with rotation of the rotor shaft, the bush outer circumferential surface having a spherical shape that swells outward in a radial direction of the rotor shaft and has a first curvature, a retainer that has a retainer inner circumferential surface and is supported on the retainer bush to rock about an axis perpendicular to the rotor shaft, the retainer inner circumferential surface having a concave spherical shape that has the first curvature and is slidably fit on the bush outer circumferential surface, a plurality of piston rods that are disposed to extend in the axial direction and connect the plurality of pistons and the retainer, the plurality of piston rods rotating the retainer about the central axis along with the plurality of pistons revolving about the central axis, a swash plate that is disposed in a side opposite the cylinder block in the axial direction to oppose the retainer and supported by the housing to rock about the axis, a thrust bearing that is interposed between the swash plate and the retainer in the axial direction and supports the retainer to allow the retainer to rotate about the central axis relative to the swash plate, and a tilt regulation mechanism that regulates a moving distance in the axial direction of the reciprocating piston by rocking the swash plate about the axis and rocking the retainer about the axis via the thrust bearing with the retainer inner circumferential surface sliding against the bush outer circumferential surface.

DESCRIPTION OF EMBODIMENTS

Figure 1:
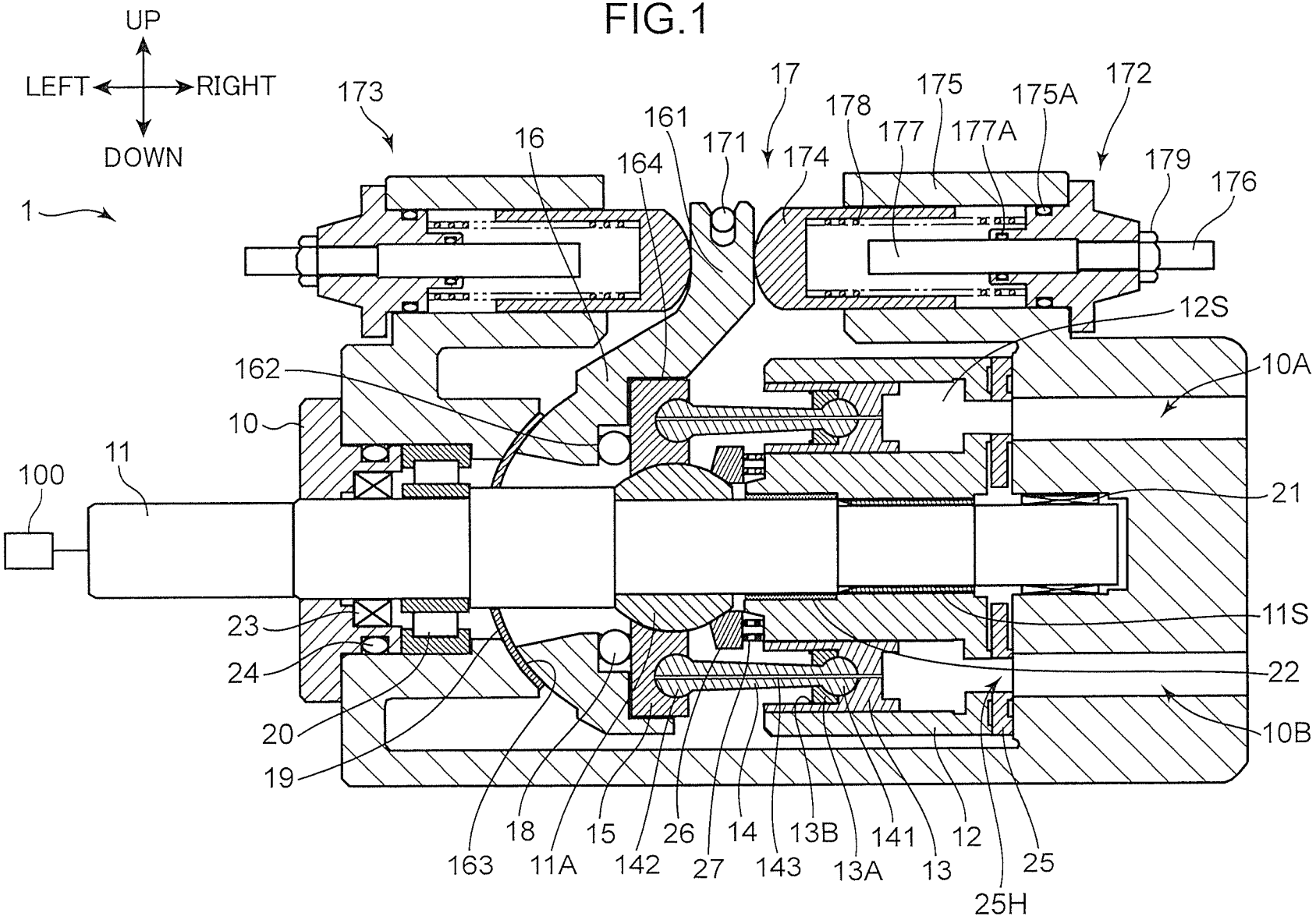
FIG. 1 is a sectional view of a hydraulic rotary machine according to an embodiment of the present invention used as a hydraulic pump.
Figure 2:
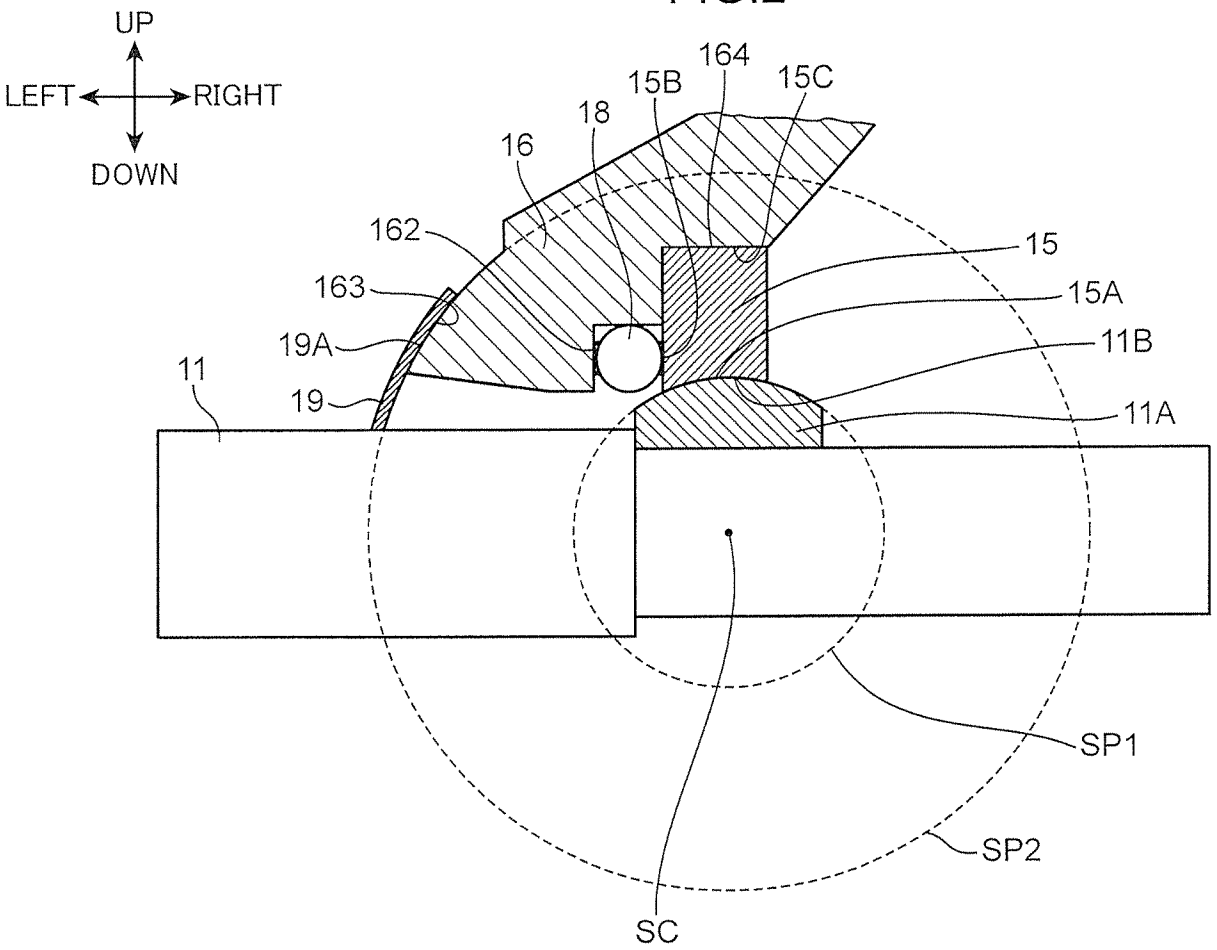
FIG. 2 is an enlarged sectional view of a portion of the hydraulic rotary machine illustrated in FIG. 1.
Figure 3:
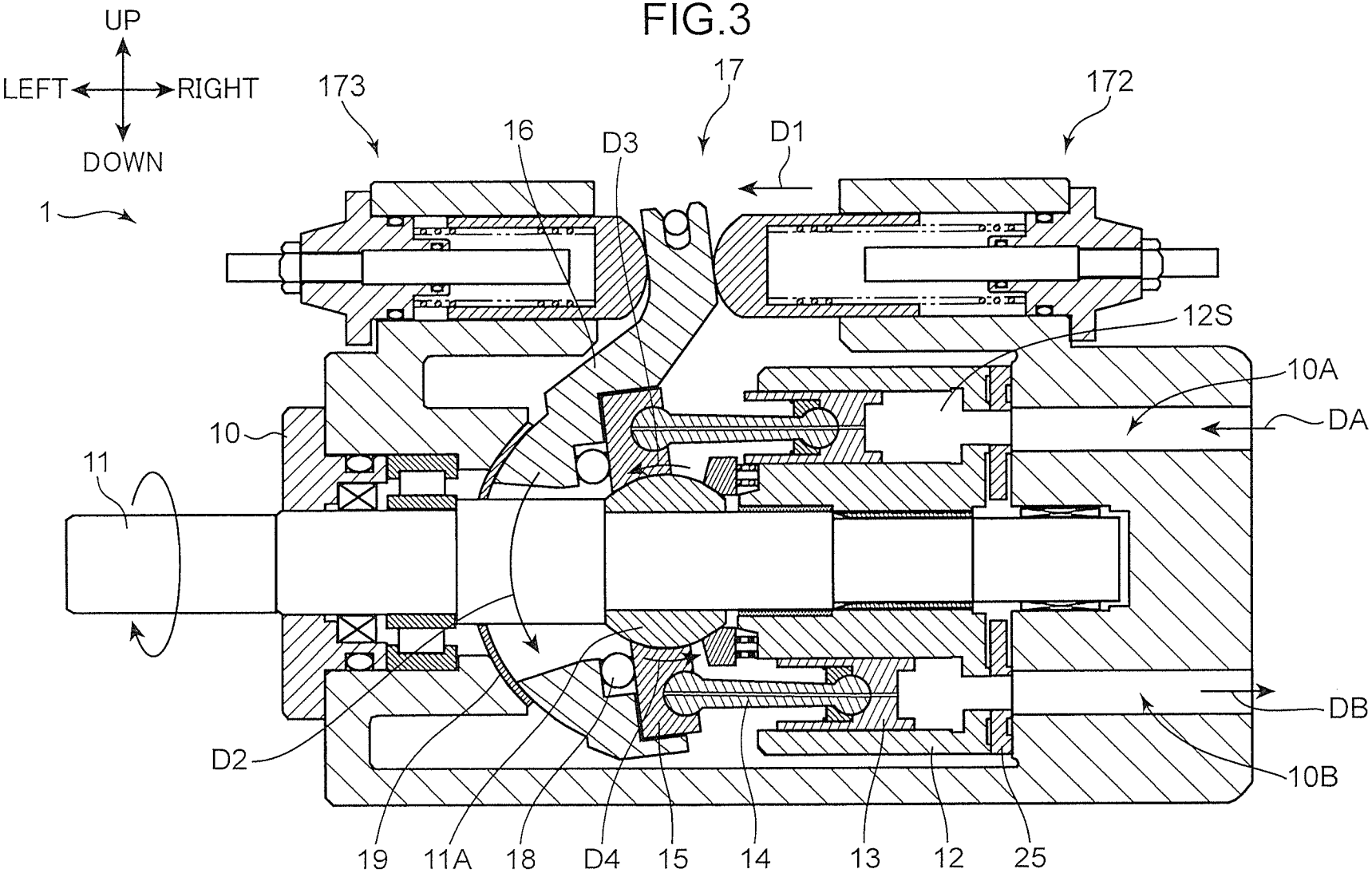
FIG. 3 is a sectional view illustrating a tilted swash plate in the hydraulic rotary machine illustrated in FIG. 1.
Figure 4A:
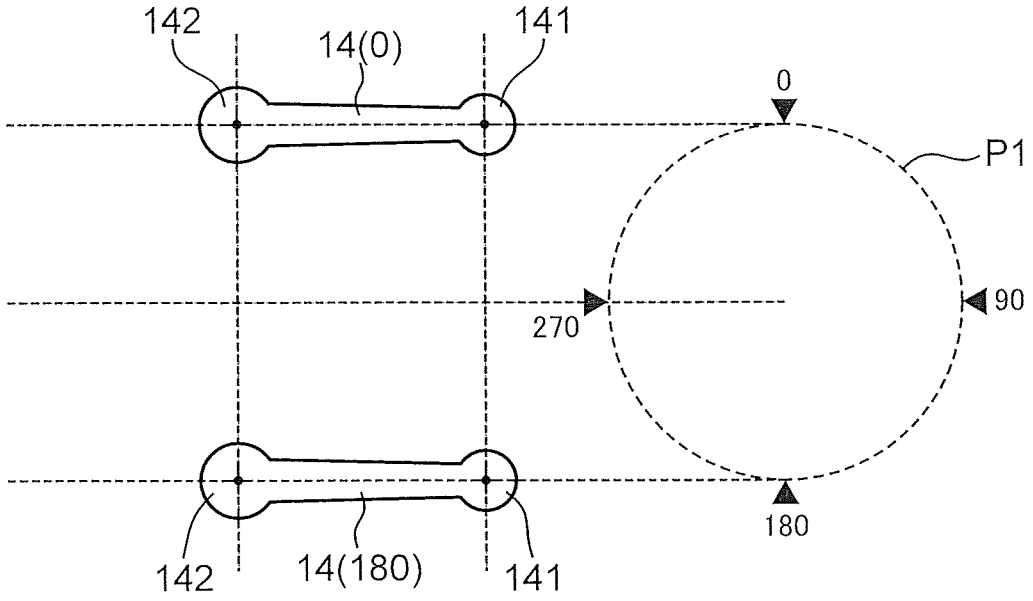
FIG. 4A is a schematic view illustrating a revolution trajectory of a piston rod in the hydraulic rotary machine according to an embodiment of the present invention when the swash plate is not tilted.
Figure 4B:
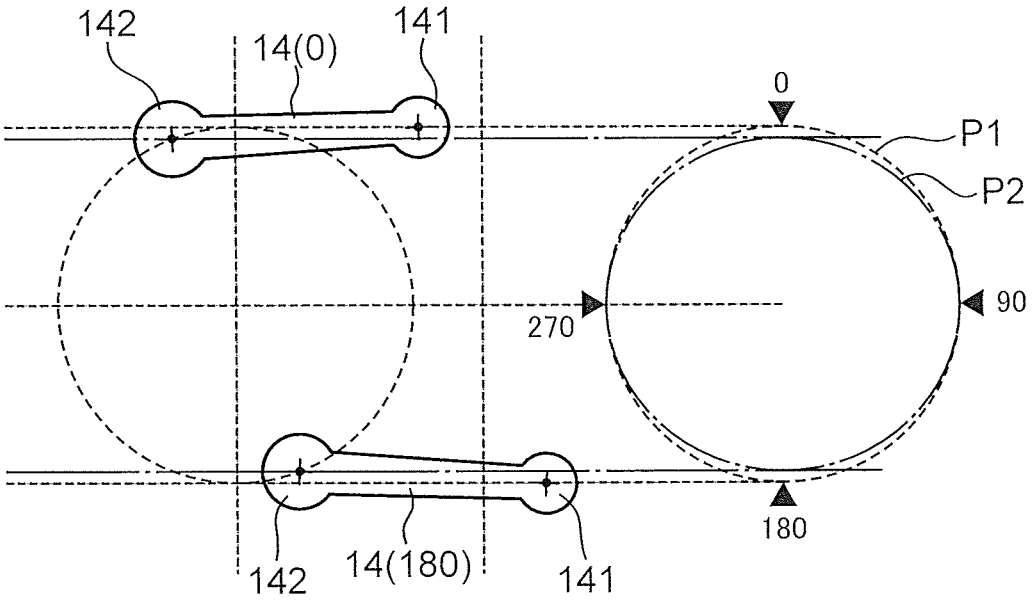
FIG. 4B is a schematic view illustrating a revolution trajectory of the piston rod in the hydraulic rotary machine according to an embodiment of the present invention when the swash plate is tilted.
Figure 5:
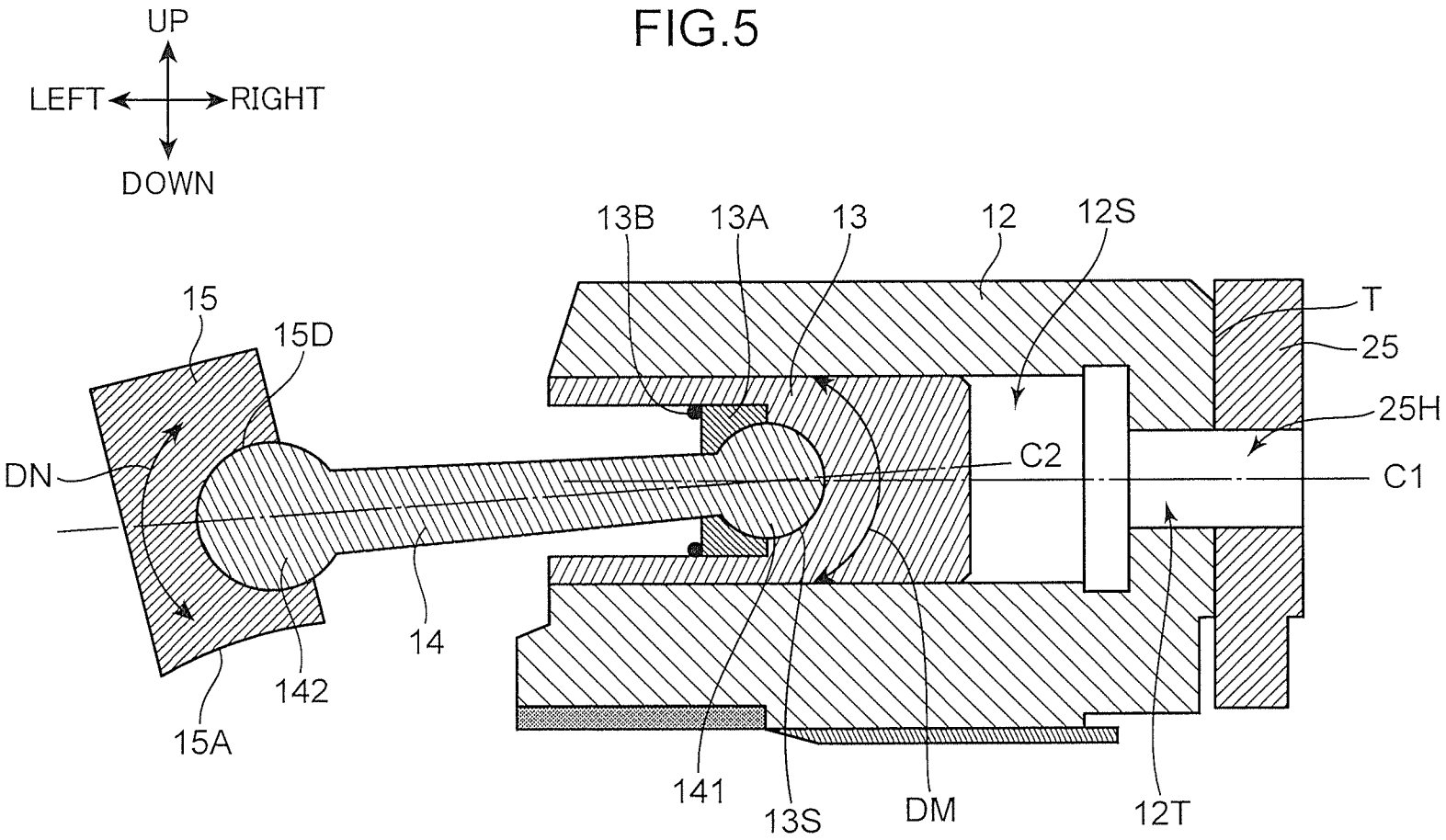
FIG. 5 is an enlarged sectional view for describing slanting of the piston rod in the hydraulic rotary machine according to an embodiment of the present invention.

Embodiments of the present invention will now be described with reference to the drawings. FIG. 1 is a perspective view of a piston pump 1 according to an embodiment of a hydraulic rotary machine of the present invention. FIG. 2 is an enlarged sectional view of a portion of the piston pump 1 illustrated in FIG. 1. FIG. 3 is a sectional view illustrating a tilted swash plate 16, which will be described later, in the piston pump 1 illustrated in FIG. 1. FIG. 4A is a schematic view illustrating a revolution trajectory of a piston rod 14 in the piston pump 1 when a swash plate 16 is not tilted. FIG. 4B is a schematic view illustrating the revolution trajectory of the piston rod 14 in the piston pump 1 when the swash plate 16 is tilted. FIG. 5 is an enlarged sectional view for describing slanting of the piston rod 14 in the piston pump 1. Hereinafter, directions in the drawings indicated by "UP", "DOWN", "LEFT", "RIGHT", "FRONT", and "REAR" are referred for convenience for describing the structure of the piston pump 1 according to the embodiment and shall not be construed to limit the mode of usage of the hydraulic rotary machine according to the present invention.

The piston pump 1 of a variable displacement type according to the embodiment is connected to a driving unit 100, such as an engine, to work as a hydraulic pump for discharging hydraulic oil. The piston pump 1 includes a housing 10, a rotor shaft 11, a cylinder block 12, a plurality of piston heads 13 (pistons), and piston rods 14. The piston pump 1 further includes a retainer 15, the swash plate 16, a tilt regulation mechanism 17, a thrust bearing 18, and a swash plate receiver 19 (swash plate support).

The housing 10 serves as a casing that supports the components of the piston pump 1. The rotor shaft 11 is rotatably supported by the housing 10. The rotor shaft 11 is connected to the driving unit 100 and is rotated in the direction indicated by an arrow in FIG. 3 by a rotationally driving force generated by the driving unit 100. A left end side of the rotor shaft 11 is rotatably supported by a roller bearing 20 disposed in the housing 10. Likewise, a right end side of the rotor shaft 11 is rotatably supported by a needle bearing 21 disposed in the housing 10. An oil seal 23 and an O-ring 24 are disposed in a left of the roller bearing 20 to prevent leakage of the hydraulic oil from inside the piston pump 1. In a right end side of the housing 10, a first passage 10A and a second passage 10B are provided to discharge and suction the hydraulic oil.

In an approximately middle portion, in a right-and-left direction, of the rotor shaft 11, a retainer bush 11A is provided. The retainer bush 11A is a cylindrical member of which outer circumferential surface (retainer bush sphere section 11B) has a spherical shape (FIG. 2). The retainer bush 11A is held on the rotor shaft 11 so as to rotate about a central axis of the rotor shaft 11 together with the rotating rotor shaft 11. In the embodiment, the retainer bush 11A is fitted on the outer circumference of the rotor shaft 11 to rotate with the rotor shaft 11 integrally.

With reference to FIG. 2, the retainer bush sphere section 11B (bush outer circumferential surface) has a spherical shape swelling outward in a radial direction of the rotor shaft 11 and having a first curvature with a center on spherical center SC. The spherical center SC is on a center line (rotational axis) of the rotor shaft 11. The retainer bush sphere section 11B holds the retainer 15, which will be described later, to allow the retainer 15 to rock.

The cylinder block 12 is a unit having an approximately cylindrical shape disposed to surround the rotor shaft 11. The cylinder block 12 engages with the rotor shaft 11 by a spline 11S. Thus, the cylinder block 12 rotates with the rotor shaft 11 about the central axis of the rotor shaft 11 integrally. A bush 22 is disposed in a left side of the spline 11S and between the rotor shaft 11 and the inner circumferential surface of the cylinder block 12. The bush 22 absorbs shuddering of the rotating cylinder block 12 caused by a play at the spline 11S.

The cylinder block 12 includes a plurality of cylinders 12S intermittently provided around the rotor shaft 11. The cylinders 12S are each a cylindrical space extending in the right-and-left direction. In the embodiment, nine cylinders 12S are provided around the rotor shaft 11 at equal intervals. Each of the cylinders 12S is formed of a control aperture 12T (see FIG. 5). A valve plate 25 is fixed between the cylinder block 12 and a right end portion of the housing 10. The valve plate 25 does not rotate and slides against the cylinder block 12 (see FIG. 5 for slide surface T). The valve plate 25 is an approximately disk-shaped member disposed so as to surround the rotor shaft 11. The valve plate 25 is provided with a plurality of valve apertures 25H. Some of the valve apertures 25H communicate with the first passage 10A and the other valve apertures 25H communicate with the second passage 10B. When the cylinder block 12 rotates together with the rotor shaft 11, the control apertures 12T of a plurality of cylinders 12S (FIG. 5) alternately communicate with the first passage 10A or the second passage 10B via the valve apertures 25H. In the case that the hydraulic rotary machine works as the piston pump 1 as in the embodiment, the cylinders 12S in a low pressure side communicate with the first passage 10A which is a suction side and the cylinders 12S in a high pressure side communicate with the second passage 10B which is a discharge side (FIG. 3). In the case that the hydraulic rotary machine works as a piston motor 1A (see FIG. 6) as in an exemplary modification which will be described later, the cylinders 12S in the high pressure side communicate with the second passage 10B which is the suction side and the cylinders 12S in the low pressure side communicate with the first passage 10A which is the discharge side.

Each of the piston head 13 is housed in each of the plurality of cylinders 12S in the cylinder block 12. The piston head 13 reciprocates in the cylinder 12S along an axial direction (right-and-left direction) as the cylinder block 12 rotates and at the same time, the piston head 13 revolves with the cylinder block 12 about the central axis of the rotor shaft 11. A volume of the cylinder 12S changes by reciprocation of the piston head 13, and thereby the hydraulic oil is suctioned and discharged.

A plurality of piston rods 14 are disposed to extend in the axial direction of the rotor shaft 11 (right-and-left direction) and connect a plurality of piston heads 13 and the retainer 15. Thus, the piston rod 14 rotates the retainer 15 about the central axis along with the piston heads 13 revolving about the central axis. The piston rod 14 is a bar-shaped member having an approximately cylindrical shape. In more detail, the piston rod 14 has a head-side end 141 (first end) and a retainer-side end 142 (second end). An oil passage 143 which extends in the right-and-left direction is provided in the piston head 13 and the piston rod 14. Through the oil passage 143, a portion of the hydraulic oil in the cylinder 12S is transferred to a gap between the retainer-side end 142 and the retainer 15. This prevents adhesive wear of the piston head 13, the piston rod 14, and the retainer 15 while the rotor shaft 11 rotates along with an operation of the piston pump 1.

The head-side end 141 has a spherical shape and is connected to a piston head holder 13S (FIG. 5) (first connecting portion) that has a hemispherical shape (spherical shape) and is formed in the piston head 13. The spherical surfaces of the head-side end 141 and the piston head holder 13S make surface contact with each other. That is, the head-side end 141 of the piston rod 14 and the piston head holder 13S are connected to each other to pivot relative to each other. A left side of the head-side end 141 is locked by a head fastening ring 13A (FIGS. 1 and 5). The head fastening ring 13A is fixed by a stopper ring 13B. In such a configuration, the head-side end 141 is supported by the piston head 13 to pivot in the radial direction and a circumferential direction of the rotor shaft 11 (about the central axis of the rotor shaft 11). With the head-side ends 141 connected to the piston head 13, the piston heads 13 and the piston rods 14 rotate together with the rotor shaft 11 integrally.

Similarly, the retainer-side end 142 has a spherical shape and is fit in and connected to a retainer holder 15D (FIG. 5) (second connecting portion) that has a hemispherical shape (spherical shape) and is provided in the retainer 15. In such a configuration, the retainer-side end 142 is supported by the retainer 15 to pivot in the radial direction and the circumferential direction of the rotor shaft 11 (about the central axis of the rotor shaft). The spherical surfaces of the retainer-side end 142 and the retainer holder 15D make surface contact with each other. That is, the retainer-side end 142 of the piston rod 14 and the retainer holder 15D are connected to pivot relative to each other. Thus, a contact pressure between the piston rod 14 and the piston head 13 and a contact pressure between the piston rod 14 and the retainer 15 can be reduced. Consequently, the adhesive wear of the piston rod 14 is suppressed. With the retainer-side end 142 connected to the retainer 15, the piston rods 14 and the retainer 15 rotate together with the rotor shaft 11 integrally.

The retainer 15 is disposed to oppose the cylinder block 12 along the axial direction of the rotor shaft 11. The retainer 15 is a ring member with an inner circumferential surface having a spherical shape (retainer sphere section 15A). The retainer sphere section 15A of the retainer 15 is slidably fit in the retainer bush sphere section 11B of the retainer bush 11A. The retainer 15 is supported on the retainer hush 11A to rock about an axis extending in a direction perpendicular to the rotor shaft 11 (a direction intersecting the rotor shaft 11 and perpendicular to the sheet on which FIG. 1 is drawn, namely, a front-and-rear direction). The axis described above passes the spherical center SC in FIG. 2 and extends in the direction perpendicular to the sheet on which FIG. 2 is drawn.

With reference to FIG. 2, the retainer 15 includes the retainer sphere section 15A (retainer inner circumferential surface), a sliding portion 15B, a swash plate opposing portion 15C (retainer outer circumferential surface), and the retainer holder 15D (second shaft support).

The retainer sphere section 15A is an inner circumferential surface of the retainer 15 continuously encircling the central axis of the rotor shaft 11. The retainer sphere section 15A is concaved outward in the radial direction of the rotor shaft 11 and has a spherical shape having the same first curvature as the retainer bush sphere section 11B. The retainer 15 rocks rightward and leftward about the spherical center SC in FIG. 2 in association with the rocking of the rocking swash plate 16. In this motion, the retainer sphere section 15A slides against the retainer bush sphere section 11B.

The sliding portion 15B is a left side face of the retainer 15 which opposes the thrust bearing 18. When the retainer 15 rotates together with the rotor shaft 11, the sliding portion 15B slides against the thrust bearing 18. The swash plate opposing portion 15C corresponds to an outer circumferential surface of the retainer 15 and is in a radially outer side than the retainer sphere section 15A.

The swash plate 16 is supported in the housing 10 to rock. In particular, the swash plate 16 is disposed in the side opposite the cylinder block 12, in the axial direction, to oppose the retainer 15. The tilt regulation mechanism 17 rocks the swash plate 16. The swash plate 16 has an approximately hemispherical shape encircling the rotor shaft 11 and is disposed so as to oppose the retainer 15. The swash plate 16 has a swash plate regulator 161 that extends from a top end of the approximately hemispherical shape portion. The swash plate regulator 161 is moved rightward and leftward by the tilt regulation mechanism 17. By this movement, the swash plate 16 rocks rightward and leftward about the spherical center SC in FIG. 2. The swash plate 16 has, in addition to the swash plate regulator 161, a bearing holder 162 (holing surface), a swash plate sphere section 163 (supported portion), and a retainer opposing portion 164 (opposing surface).

The bearing holder 162 holds the thrust bearing 18. The bearing holder 162 is an annular wall surface that extends in directions perpendicular to the axial direction of the rotor shaft 11. The swash plate sphere section 163 is disposed further in the left side than the bearing holder 162, in other words, in the side opposite the bearing holder 162 in the axial direction. The swash plate sphere section 163 includes a portion of the spherical surface that has a center on the same spherical center SC as the retainer bush sphere section 11B. The spherical shape of the swash plate sphere section 163 has a second curvature smaller than the first curvature of the retainer bush sphere section 11B. In other words, with reference to FIG. 2, the spherical shape of the retainer bush sphere section 11B traces a first imaginary spherical plane SP1 and the spherical shape of the swash plate sphere section 163 traces a second imaginary spherical plane SP2 concentric with the first imaginary spherical plane SP1. A radius of the second imaginary spherical plane SP2 (curvature radius of the retainer bush sphere section 11B) is larger than a radius of the first imaginary spherical plane SP1 (curvature radius of swash plate sphere section 163).

The retainer opposing portion 164 is an inner circumferential surface of the swash plate 16 that opposes the swash plate opposing portion 15C of the retainer 15 in the radial direction. Although not illustrated in detail in FIG. 2, a gap is provided between the swash plate opposing portion 15C and the retainer opposing portion 164. In the embodiment, the swash plate 16 is not in direct contact with the retainer 15.

The tilt regulation mechanism 17 is disposed above the cylinder block 12. The tilt regulation mechanism 17 rocks the swash plate 16 rightward and leftward about the spherical center SC in FIG. 2 and thereby rocks the retainer 15 via the thrust bearing 18 about the spherical center SC with the retainer sphere section 15A sliding against the retainer bush sphere section 11B. Thus, the tilt regulation mechanism 17 regulates a moving distance of the reciprocating piston head 13 in the axial direction. That is, the tilt regulation mechanism 17 regulates a flow discharge amount of the piston pump 1.

The tilt regulation mechanism 17 includes a swash plate switching portion 171, a first tilt regulator 172, and a second tilt regulator 173. The swash plate switching portion 171 is fit in a recess provided in a top end of the swash plate regulator 161. A driving force transferred to the swash plate switching portion 171 moves the swash plate regulator 161 rightward and leftward. The first tilt regulator 172 urges the swash plate regulator 161 from the right side. Similarly, the second tilt regulator 173 urges the swash plate regulator 161 from the left side. The first tilt regulator 172 and the second tilt regulator 173 are configured the same. The structure of the first tilt regulator 172 will be described below.

The first tilt regulator 172 includes a tilt piston 174, a regulation housing 175, a shaft 176, a tilt piston spring 178, and a fastener 179. The regulation housing 175 supports the parts of the first tilt regulator 172. The tilt piston 174 is slidably movable in the right-and-left direction in the regulation housing 175. A distal end (left end) of the tilt piston 174 is in contact with the swash plate regulator 161 of the swash plate 16. The shaft 176 extends into the inside of the regulation housing 175. A right end of the regulation housing 175 is fixed to the shaft 176 by the fastener 179 which has a form of a nut. The tilt piston spring 178 made of a coil spring is disposed between the inner circumferential surface of the tilt piston 174 and the regulation housing 175. By an urging force of the tilt piston spring 178, the tilt piston 174 urges the swash plate regulator 161 leftward. O-rings 175A and 177A are disposed respectively in the inside of the regulation housing 175 and on the outer circumferential surface of a tilt stopper 177 to prevent oil leakage.

The thrust bearing 18 is interposed between the swash plate 16 and the retainer 15, in the axial direction of the rotor shaft 11. In more detail, the thrust bearing 18 is disposed between the bearing holder 162 of the swash plate 16 and the sliding portion 15B of the retainer 15. The thrust bearing 18 supports the retainer 15 to allow the retainer 15 to rotate, relative to the swash plate 16, about the central axis of the rotor shaft 11.

The swash plate receiver 19 (FIG. 1) is a member having an approximately hemispherical shape and disposed in the housing 10 so as to oppose the swash plate 16. The swash plate receiver 19 includes a spherical surface 19A opposing the swash plate sphere section 163 (FIG. 2) of the swash plate 16. The spherical surface 19A has the same second curvature as the swash plate sphere section 163 of the swash plate 16 (FIG. 2). The swash plate receiver 19 supports the swash plate sphere section 163 of the swash plate 16 to allow the swash plate 16 to rock rightward and leftward about the spherical center SC. Thus, the swash plate 16 rocks rightward and leftward by the tilt regulation mechanism 17 with the swash plate sphere section 163, which is in surface contact with the spherical face 19A, sliding against the spherical surface 19A. As illustrated in FIG. 2, the swash plate receiver 19 is disposed in the housing 10 so as to catch a portion of the swash plate 16 between, in the axial direction (right and left direction), the swash plate receiver 19 and the thrust bearing 18.

The piston pump 1 further includes a block supporting portion 26, and a block urging spring 27 (FIG. 1). The block supporting portion 26 and the block urging spring 27 are disposed in a radial location of the piston rod 14. The block supporting portion 26 is a ring-shaped member in contact with the retainer bush sphere section 11B (FIG. 2) of the retainer bush 11A. A portion of the block supporting portion 26 that is in contact with the retainer bush sphere section 11B has a spherical shape having the same curvature as the retainer sphere section 15A of the retainer 15. The block urging spring 27 is a spring member interposed between the block supporting portion 26 and the cylinder block 12. The block urging spring 27 urges the cylinder block 12 toward the valve plate 25. While the cylinder block 12 is rotating, an elastic force of the block urging spring 27 reduces shuddering of the cylinder block 12 in the axial direction (right and left direction).

In the case that the tilt of the piston pump 1 is regulated, the tilt regulation mechanism 17 moves the swash plate regulator 161 from the state illustrated in FIG. 1 in the direction indicated by an arrow D1 (FIG. 3). An external force acting on the swash plate switching portion 171 (FIG. 1) balances with the urging forces of the tilt piston springs 178 of the first tilt regulator 172 and the second tilt regulator 173 so that the regulated position of the swash plate 16 is determined. Along with the movement of the swash plate regulator 161, the swash plate 16 smoothly rocks along the spherical shape of the swash plate receiver 19 in the direction indicated by an arrow D2 about the spherical center SC (FIG. 2). In this motion, the retainer 15 rocks in directions indicated by an arrow D3 and an arrow D4 along the retainer bush 11A via the thrust bearing 18. By rocking of the retainer 15, the piston head 13 connected to the retainer 15 via the piston rod 14 moves in the axial direction in the cylinder 12S. In particular, in FIG. 3, the piston head 13 located in the uppermost moves leftward and the piston head 13 located in the lowermost moves rightward. The volume of each cylinder 12S thereby changes by rotation of the cylinder block 12. That is, a discharge volume of the piston pump 1 changes by tilting of the swash plate 16.

In the embodiment as described above, nine cylinders 12S and nine piston heads 13 are disposed in the cylinder block 12. With an odd number of cylinders 12S provided, oil pressure pulsation generated by the rotationally driven cylinder block 12 is reduced. In other words, if an even number of cylinders 12S and the same number of piston heads 13 are provided, the oil pressure pulsations caused by the cylinders 12S at symmetric positions with respect to a radial direction resonate and become greater.

With reference to FIGS. 1 and 4A, a case where the swash plate 16 is not controlled to tilt and the retainer 15 is disposed perpendicular to the axial direction of the rotor shaft 11 will be described. In this case, the piston head 13 at any phase does not move in the axial direction of the rotor shaft 11 while the piston rod 14 makes one revolution about the central axis of the rotor shaft 11. Thus, the retainer-side end 142 of the piston rod 14 traces a revolution trajectory of a true circle P1. In FIG. 4A, angles 0, 90, 180, and 270 indicated in the periphery of the revolution trajectory P1 and near the piston rod 14 represent phase angles. In this case, revolving of nine piston heads 13 cancel each other, and no shuddering occurs about the rotor shaft of the cylinder block 12.

With reference to FIGS. 3 and 4B, a case where the swash plate 16 is controlled to tilt and where the discharge volume of the piston pump 1 is larger than 0 will be described. In this case, the location of the piston head 13 in the axial direction changes corresponding to the phase as the piston rod 14 makes one revolution about the central axis of the rotor shaft. Thus, as illustrated in FIG. 4B, the retainer-side end 142 of the piston rod 14 traces a revolution trajectory of an ellipse P2. In FIG. 4B, angles 0, 90, 180, and 270 indicated in the periphery of the revolution trajectory P2 and near the piston rod 14 represent phase angles. In particular, the distance between the piston rod 14 and the rotational axis of the rotor shaft 11 becomes shorter as compared to the case in FIG. 4A when the piston rod 14 is at phases of 0 degree and 180 degrees. Meanwhile, the distance between the piston rod 14 and the rotational axis of the rotor shaft 11 becomes larger as compared to the case in FIG. 4A when the piston rod 14 is at phases of 90 degrees and 270 degrees. In FIG. 5, the piston rod 14 at the phase of 0 degree in FIG. 4B is illustrated in an enlarged manner. When the swash plate 16 is tilted as in FIG. 3, the axis of the piston rod 14 slants from a first imaginary axis C1 corresponding to FIG. 4A to a second imaginary axis C2. By this motion, the head-side end 141 of the piston rod 14 pivots in the piston head holder 13S of the piston head 13. With the piston rod 14 changing the orientation depending on the phase, the revolution trajectory of the piston rod 14 traces the ellipse P2 as described above. In this case, revolving of the nine piston heads 13 do not cancel each other. Thus, shuddering of the cylinder block 12 about the rotor shaft is likely to increase.

Even in such a case, in the embodiment, the retainer 15 is supported by the retainer bush 11A fit on the rotor shaft 11. The retainer sphere section 15A of the retainer 15 and the retainer bush sphere section 11B of the retainer bush 11A have the same spherical shape having the first curvature and make surface contact by the spherical surfaces thereof. Consequently, the rotor shaft 11 stably supports a plurality of revolving piston heads 13, and thus the unstable revolving of the piston heads 13 is suppressed. Since there is a gap between the swash plate opposing portion 15C of the retainer 15 and the retainer opposing portion 164 of the swash plate 16, a force does not acts on the retainer 15 from radially outer side. Thus, the retainer 15 is given a degree of freedom and unstable revolving of the piston head 13 is easily absorbed. As long as the effect described above can be obtained, the retainer bush 11A may rotate together with the rotor shaft 11 integrally, or the retainer bush 11A may rotate with a slight difference in rotational velocity from that of the rotor shaft 11. In such a case, the rotor shaft 11 rotates approximately integrally with the cylinder block 12, the piston heads 13, the piston rods 14, and the retainer 15 at the same tangential velocity.

In the embodiment, the retainer sphere section 15A of the retainer 15 and the retainer bush sphere section 11B of the retainer bush 11A have spherical shapes having the same first curvature, and thus the retainer 15 can rotate along the retainer bush 11A when the tilt is regulated. Furthermore, the swash plate receiver 19 has, when viewed in the sectional view in FIG. 1, a spherical shape concentric with the spherical shape of the retainer bush sphere section 11B, so that the retainer 15 can readily rock along with rocking of the swash plate 16. This smooth tilting of the swash plate 16 along with the movement of the retainer 15, the piston rods 14, and the piston heads 13 improves responsiveness of tilt control. Furthermore, in this structure, the discharge volume of the piston pump 1 (reciprocating stroke of the piston) is regulated, and thus there is no need to tilt the cylinder block 12 relative to the rotor shaft 11. Thus, the responsiveness during regulating the tilt can be improved, which prevents the tilt control mechanism of the piston pump 1 from becoming complex.

In the embodiment as illustrated in FIG. 5, the head-side end 141 of the piston rod 14 can pivot relative to the piston head 13 in a radial direction (arrow DM in FIG. 5), and the retainer-side end 142 can pivot relative to the retainer 15 in a radial direction (arrow DN in FIG. 5). In other words, the head-side end 141 and the retainer-side end 142 of the piston rod 14 have degree of freedom of pivoting relatively to the piston head 13 and the retainer 15, respectively. A radial shudder or play of the piston head 13 that happens when the cylinder block 12 rotates is absorbed by slanting of the piston rod 14. Furthermore, a contact between the piston head 13 and the piston rod 14 has a form corresponding to the spherical shape of the head-side end 141, and a contact between the piston head 13 and the retainer 15 has a form corresponding to the spherical shape of the retainer-side end 142. Thus, the surface pressure of the piston rod 14 is reduced, which suppresses the adhesive wear of the piston rod 14 during an operation.

Furthermore, in the embodiment, the retainer 15 and the swash plate 16 are connected by the thrust bearing 18. This configuration reduces sliding resistance produced during rotation compared to a hydraulic rotary machine in which components make a direct contact with each other without a bearing therebetween. In the embodiment, the reciprocating piston head 13 and the swash plate 16 do not make a direct contact. This configuration enables reduction in the leakage of the hydraulic oil supplied as a lubricant to the sliding portion in the piston pump 1, and thereby the volumetric efficiency of the piston pump 1 (hydraulic rotary machine) can be improved. In the embodiment, the retainer 15 rotating together with the cylinder block 12 is supported by the retainer bush 11A provided on the rotor shaft 11. A gap is provided between the swash plate opposing portion 15C of the retainer 15 and the retainer opposing portion 164 of the swash plate 16. This configuration enables designing the piston pump 1 to be small in size in the radial direction compared to a configuration in which a radial bearing is disposed between the retainer 15 and the swash plate 16.

Furthermore in the embodiment, as illustrated in FIG. 2, the swash plate receiver 19 is disposed in the housing 10 so as to catch a portion of the swash plate 16 between, along the axial direction, the swash plate receiver 19 and the thrust bearing 18. With this configuration, the thrust bearing 18 and the swash plate 16 can stably support the retainer 15 even when a large pushing force acts leftward on the retainer 15 by the reciprocating piston head 13.

The piston pump 1 (hydraulic rotary machine) according to an embodiment of the present invention is described above. The present invention is not limited to the embodiment. A hydraulic rotary machine according to the present invention may take a form of an exemplary modification as described below.

Figure 6:
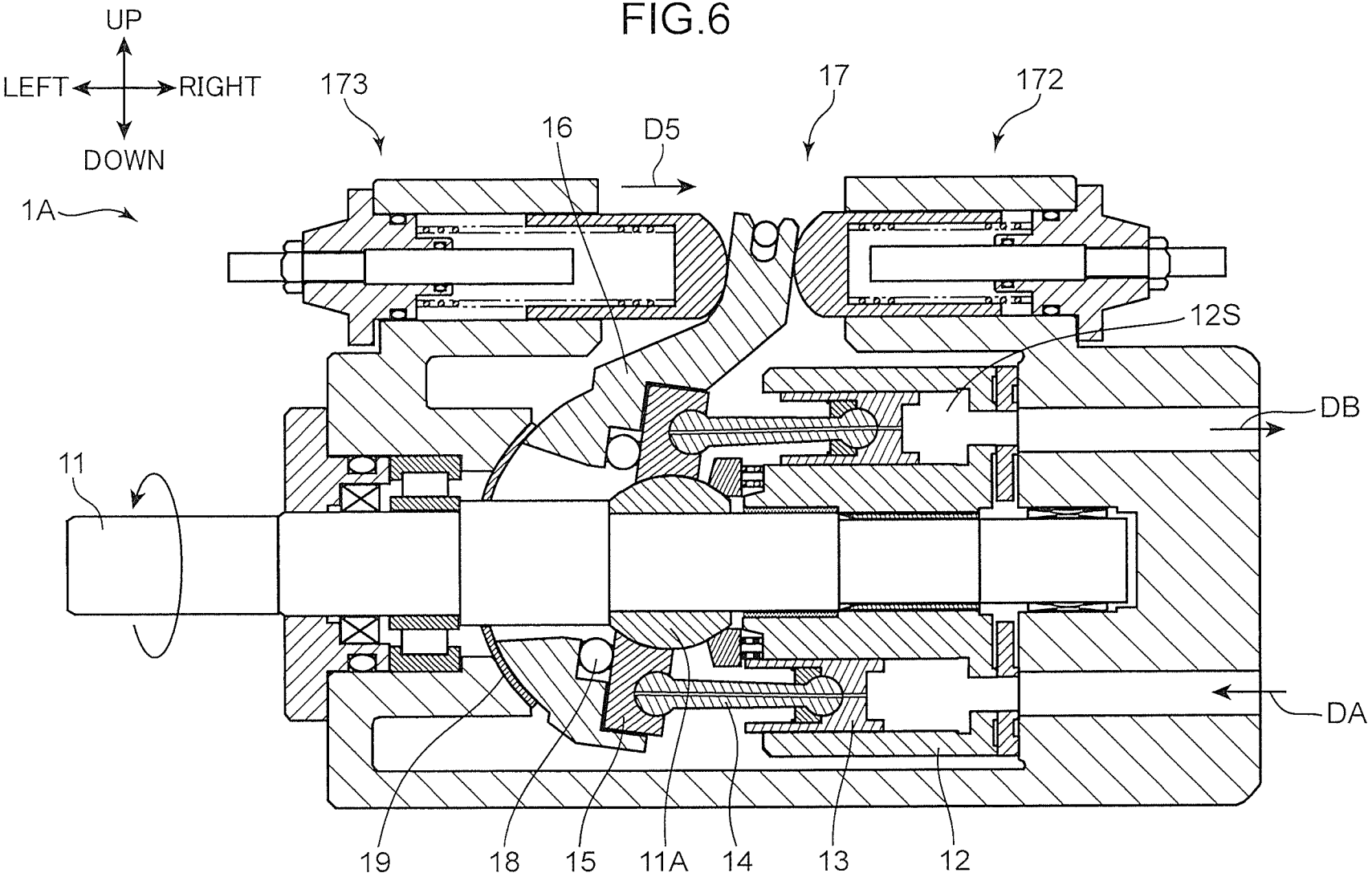
FIG. 6 is a sectional view of a hydraulic rotary machine according to an exemplary modification of the present invention used as a hydraulic motor.

(1) In the embodiment described above, the piston pump 1 is described as a hydraulic rotary machine of a variable displacement type. However, the present invention is not limited to this embodiment. FIG. 6 is a sectional view of a hydraulic rotary machine according to an exemplary modification of the present invention used as a piston motor 1A (hydraulic motor). For example, in the piston motor 1A in FIG. 6, the swash plate 16 rocks by the tilt regulation mechanism 17 in a direction indicated by an arrow D5. This rocking causes the piston head 13 to have phases that are reverse to the phases in FIG. 3. High pressure hydraulic oil flows into a cylinder 12S having a small volume, among a plurality of cylinders 12S, as indicated by an arrow DA. The hydraulic oil that has flown in acts on the piston head 13 and pushes the piston head 13 leftward. The movement of the piston head 13 is converted via the retainer 15 into the rotation of the cylinder block 12 and the rotor shaft 11. The rotor shaft 11 rotates in the direction indicated by an arrow in FIG. 6, and thereby the piston motor 1A works as a motor.

When the piston head 13 in the high pressure side moves along with the retainer 15 to the low pressure side (the upper piston head 13 in FIG. 6), the hydraulic oil is discharged in the direction indicated by an arrow DB. In the piston motor 1A in FIG. 6, the retainer 15 rocks along the spherical shape of the retainer bush 11A, and thereby variable displacement control of the piston motor 1A is performed. With the head-side end and the retainer-side end of the piston rod 14 allowed to slant at least in a radial direction relative to the piston head 13 and the retainer 15, respectively, the unstable revolving of the rotationally driven piston head 13 is suppressed. Other effects can be obtained in a manner similar to the embodiment described above. In particular, slanting of the piston rod 14 reduces the contact pressure between the piston rod 14 and the piston head 13 and the contact pressure between the piston rod 14 and the retainer 15. Consequently, the adhesive wear of the piston rod 14 is suppressed.

(2) In the embodiment described above, the head-side end 141 and the retainer-side end 142 of the piston rod 14 each has a spherical shape as illustrated in FIG. 5. However, the present invention is not limited to such a configuration. The head-side end 141 and the retainer-side end 142 each may have an arc shape in a section taken along the axial direction of the rotor shaft 11 as illustrated in FIG. 1 and have a thickness in the direction perpendicular to the sheet on which FIG. 1 is drawn. In this case, the piston head holder 13S of the piston head 13 and the retainer holder 15D of the retainer 15 (FIG. 5) each may have an arc shape in a sectional view to respectively support the head-side end 141 and the retainer-side end 142. Also in this case, the head-side end 141 is in line contact with the arc of the piston head 13 and allowed to pivot in a radial direction (relative to piston head 13), and the retainer-side end 142 is in line contact with the arc of the retainer 15 and allowed to pivot in a radial direction (relative to the retainer 15). In this manner, a radial shuddering of the piston head 13 is absorbed when the cylinder block 12 rotates.

Figure 7:
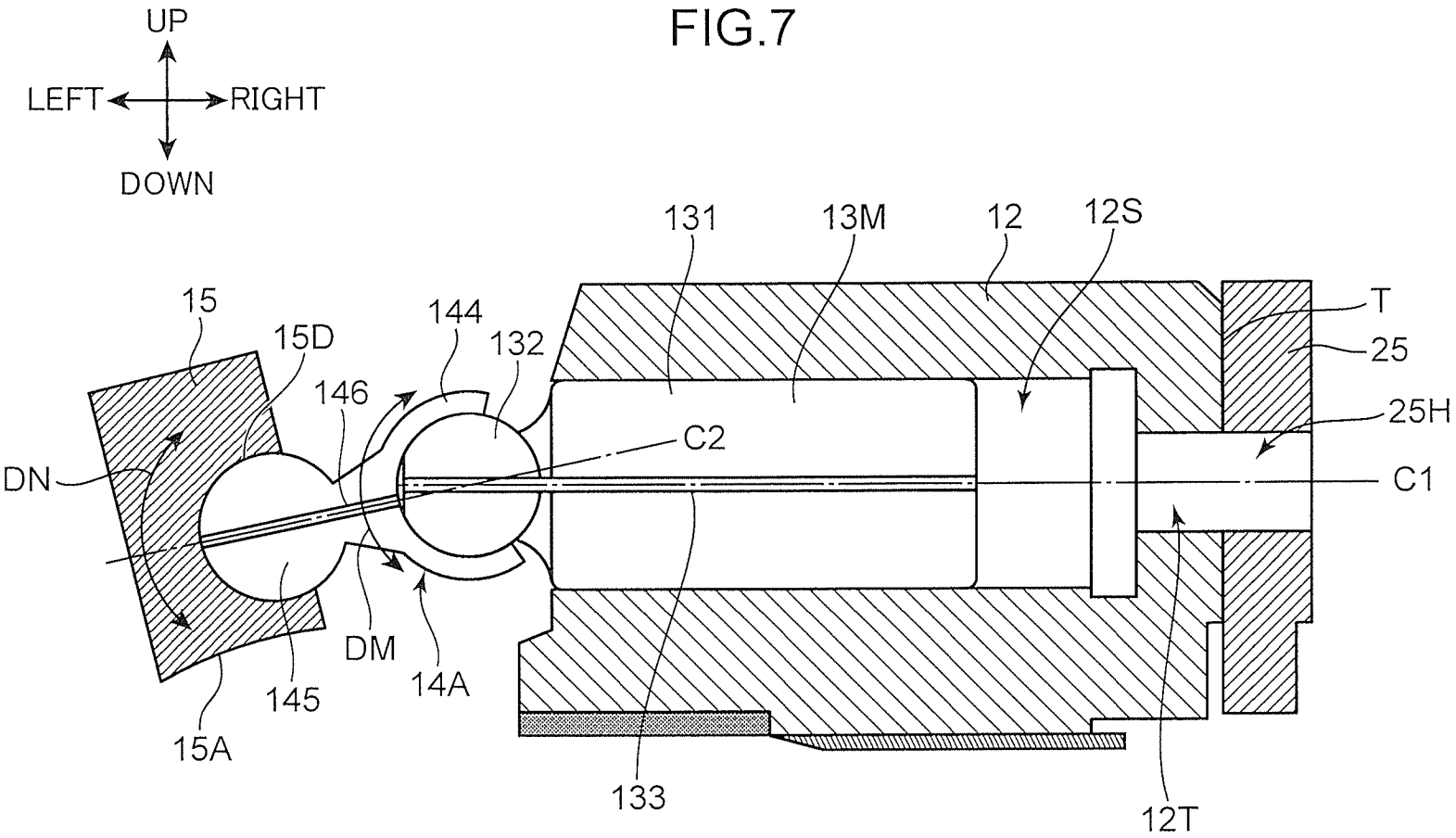
FIG. 7 is an enlarged sectional view for describing the slanting of the piston rod in the hydraulic rotary machine according to the exemplary modification of the present invention.
Figure 8:
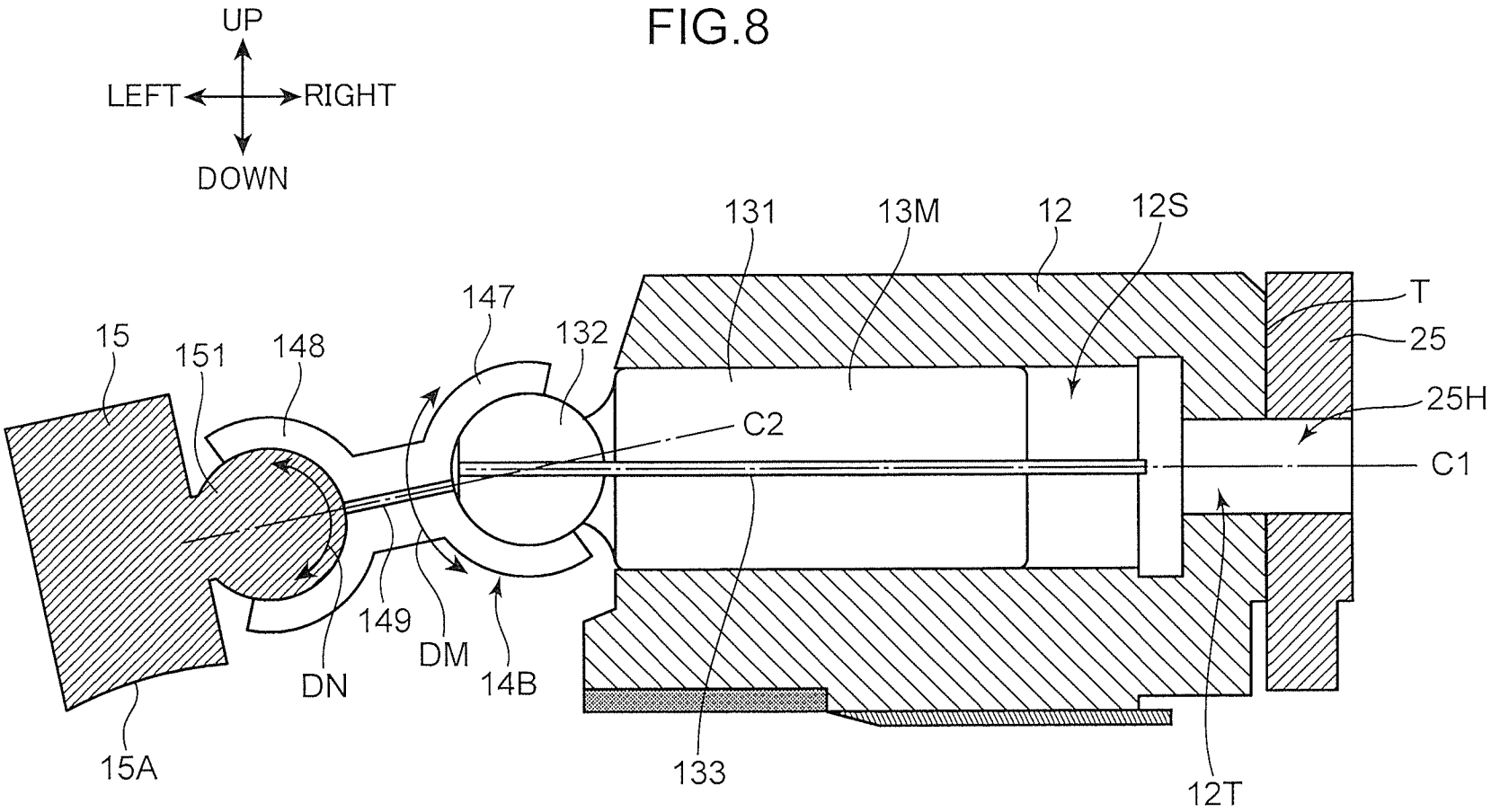
FIG. 8 is an enlarged sectional view for describing the slanting of the piston rod in the hydraulic rotary machine according to the exemplary modification of the present invention.

Furthermore, FIGS. 7 and 8 are each an enlarged sectional view for describing the slanting of the piston rod in the hydraulic rotary machine according to the exemplary modification of the present invention. In FIGS. 7 and 8, a component having the same structure and function as the embodiment described above (FIG. 5) is appended with the same reference sign as in FIG. 5. A hydraulic rotary machine illustrated in FIG. 7 includes a piston head 13M and a piston rod 14A in place of the piston head 13 and the piston rod 14 in FIG. 5. The piston head 13M includes a main body 131 having a cylindrical shape, and a spherical portion 132 (first connecting portion) that has a projecting spherical shape provided on a distal end of the main body 131. The piston rod 14A has a head-side end 144 (first end) and a retainer-side end 145 (second end). The head-side end 144 has a recess having a spherical shape having the same curvature as the spherical portion 132. The retainer-side end 145 has a projecting spherical shape similar to the spherical portion 132. The retainer 15 has a retainer holder 15D (second connecting portion). The retainer holder 15D forms a recess having a spherical shape having the same curvature as the retainer-side end 145. Oil is supplied from the cylinder 12S to each sliding portion via an oil passage 133 formed in the piston head 13M and an oil passage 146 formed in the piston rod 14A.

In the configuration illustrated in FIG. 7, the spherical portion 132 of the piston head 13M and the head-side end 144 of the piston rod 14A are connected to pivot relative to each other (arrow DM in FIG. 7). The retainer-side end 145 of the piston rod 14A and the retainer holder 15D of the retainer 15 are connected to pivot relative to each other (arrow DN in FIG. 7).

A hydraulic rotary machine illustrated in FIG. 8 includes a piston head 13M and a piston rod 14B in place of the piston head 13 and the piston rod 14 in FIG. 5. The piston head 13M is configured the same as that illustrated in FIG. 7. The piston rod 14B has a head-side end 147 (first end) and a retainer-side end 148 (second end). The head-side end 147 and the retainer-side end 148 each has a recess having a spherical shape. The retainer 15 has a spherical portion 151 (second connecting portion) having the same curvature as the inner circumferential surface of the retainer-side end 148. Also in the exemplary modification, oil is supplied from the cylinder 12S to each sliding portion via an oil passage 133 formed in the piston head 13M and an oil passage 149 formed in the piston rod 14B.

Also in the configuration illustrated in FIG. 8, the spherical portion 132 of the piston head 13M and the head-side end 147 of the piston rod 14B are connected to pivot relative to each other (arrow DM in FIG. 8). The retainer-side end 148 of the piston rod 14B and the spherical portion 151 of the retainer 15 are connected to pivot relative to each other (arrow DN in FIG. 8). The spherical shape described above needs not be an exact spherical shape. A shape close to a spherical shape (approximately spherical shape) may be used considering sliding property between components and revolving property of the piston head 13M about the rotor shaft 11. That is, the spherical shape of the present invention includes such an approximately spherical shape. In another exemplary modification, one of the head-side end 141 and the retainer-side end 142 may be supported by the piston head 13 or the retainer 15 to pivot. With such configurations illustrated in FIGS. 7 and 8, the number of parts are reduced and thus the hydraulic rotary machine can be made with low cost and can be assembled more easily.

(3) In the embodiment described above, the retainer bush 11A has a spherical shape continuing along the rotating direction of the rotor shaft 11. However, the present invention is not limited to such a configuration. Portions of the spherical shape may intermittently be disposed along the rotating direction as long as the retainer bush 11A can support the retainer 15 to rock.

The invention claimed is:

1. A hydraulic rotary machine of a variable displacement type, the hydraulic rotary machine comprising:

a housing;

a rotor shaft rotatably supported by the housing;

a cylinder block that includes a plurality of cylinders intermittently disposed around the rotor shaft and revolves together with the rotor shaft about a central axis of the rotor shaft;

a plurality of pistons that are each housed in each of the plurality of cylinders in the cylinder block and reciprocates in an axial direction in the cylinder along with rotation of the cylinder block;

a retainer bush that includes a bush outer circumferential surface and is supported on the rotor shaft to rotate about the central axis along with rotation of the rotor shaft, the bush outer circumferential surface having a spherical shape that swells outward in a radial direction of the rotor shaft and has a first curvature;

a retainer that has a retainer inner circumferential surface and is supported on the retainer bush to rock about an axis perpendicular to the rotor shaft, the retainer inner circumferential surface having a concave spherical shape that has the first curvature and is slidably fit on the bush outer circumferential surface;

a plurality of piston rods that are disposed to extend in the axial direction and connect the plurality of pistons and the retainer, the plurality of piston rods rotating the retainer about the central axis along with the plurality of pistons revolving about the central axis;

a valve plate disposed opposite to the plurality of pistons and between the housing and the cylinder block in the axial direction, the valve plate being provided with a plurality of valve apertures configured to communicate with the plurality of cylinders;

a swash plate that is disposed in a side opposite the cylinder block in the axial direction to oppose the retainer and supported by the housing to rock about the axis;

a thrust bearing that is interposed between the swash plate and the retainer in the axial direction and supports the retainer to allow the retainer to rotate about the central axis relative to the swash plate;

a tilt regulation mechanism that regulates a moving distance in the axial direction of the reciprocating piston by rocking the swash plate about the axis and rocking the retainer about the axis via the thrust bearing with the retainer inner circumferential surface sliding against the bush outer circumferential surface;

a block supporting portion that is a ring-shaped member disposed inward of the plurality of piston rods in the radial direction, the block supporting portion having a contact portion that is in contact with the bush outer circumferential surface of the retainer bush and has a concave spherical shape having the first curvature; and a block urging spring that is a spring member interposed between the block supporting portion and the cylinder block and urges the cylinder block toward the valve plate.

2. The hydraulic rotary machine according to claim 1, wherein a first end, in the axial direction, of each of the piston rods is connected to each of the pistons at least to pivot in the radial direction, and a second end, in the axial direction, of each of the piston rods is connected to the retainer at least to pivot in the radial direction.

3. The hydraulic rotary machine according to claim 2, wherein, in a sectional view taken along the axial direction, the first end and the second end of the piston rod each have an arc shape, the plurality of pistons each include a first connecting portion that has an arc shape and is connected to the first end of the piston rod, the retainer includes a plurality of second connecting portions that have each an arc shape and are connected to the second ends of the plurality of piston rods, and the first end of the piston rod and the first connecting portion are connected to pivot relative to each other in the sectional view, and the second end of the piston rod and each of the second connecting portions are connected to pivot relative to each other in the sectional view.

4. The hydraulic rotary machine according to claim 3, wherein the first end and the second end of the piston rod each have a spherical shape partially including the arc shape, and the first connecting portion and the second connecting portion have spherical shapes respectively connected to the first end and the second end of the piston rod to pivot relative to the first end and the second end, respectively, of the piston rod.

5. The hydraulic rotary machine according to claim 1, further comprising:

a swash plate support that is disposed in the housing, has a spherical shape having a second curvature, and supports a supported portion to allow the swash plate to rock about the axis, wherein in a sectional view taken along the axial direction, the swash plate includes a holding surface that holds the thrust bearing, and a supported portion that is disposed in a side opposite the holing surface in the axial direction and has a spherical shape that is concentric with the spherical shape of the bush outer circumferential surface and has the second curvature smaller than the first curvature.

* * * * *